US006799566B1

(12) United States Patent
Malucelli

(10) Patent No.: US 6,799,566 B1
(45) Date of Patent: Oct. 5, 2004

(54) AUTOMATIC COCKING DEVICE IN A CROSSBOW FOR HUNTING AND ARCHERY

(76) Inventor: Ermanno Malucelli, Strada del Rio, 11, I 43044 Ricco' di Fornovo Taro (IT)

( * ) Notice: Subject to any disclaimer, the term of this patent is extended or adjusted under 35 U.S.C. 154(b) by 0 days.

(21) Appl. No.: 10/258,625

(22) PCT Filed: Apr. 23, 2001

(86) PCT No.: PCT/IT01/00200

§ 371 (c)(1),
(2), (4) Date: Oct. 22, 2002

(87) PCT Pub. No.: WO01/92808

PCT Pub. Date: Dec. 6, 2001

(30) Foreign Application Priority Data

May 30, 2000 (IT) ..... PR2000A0035

(51) Int. Cl.[7] ..... F41B 5/12
(52) U.S. Cl. ..... 124/25
(58) Field of Search ..... 124/25, 86

(56) References Cited

U.S. PATENT DOCUMENTS 5,115,795 A * 5/1992 Farris
5,220,906 A * 6/1993 Choma
5,243,956 A * 9/1993 Luehring
5,823,172 A * 10/1998 Suggitt
6,095,128 A * 8/2000 Bednar
6,286,496 B1 * 9/2001 Bednar

* cited by examiner

*Primary Examiner*—John A. Ricci
(74) *Attorney, Agent, or Firm*—Shlesinger, Fitzsimmons & Shlesinger

(57) ABSTRACT

A crossbow (1) includes a frame (2) having at least a flexing element (3) and a bowstring (4) strung between opposite ends of the flexing element (3) positioned substantially perpendicular, under rest conditions, to the shooting axis of the crossbow. On the frame (2) is mounted a trigger block (8) provided with means for catching and releasing the bowstring. The trigger block (8) can be translated on a rectilinear path parallel to the longitudinal axis of the crosssbow, in which in a first phase the trigger block advances towards the flexing element (3) until it automatically catches the bowstring (4), and in a second phase the trigger block (8) moves back until reaching a positioning of correct tensioning of the bowstring. The trigger block is actuated by electromechanical means shaped in such a way as to produce on the trigger block (8) a force that is substantially parallel to the shooting axis of the crossbow to carry out said first and second phase.

23 Claims, 3 Drawing Sheets

AUTOMATIC COCKING DEVICE IN A CROSSBOW FOR HUNTING AND ARCHERY

TECHNICAL FIELD AND BACKGROUND ART

The present invention relates to an automatic cocking device in a crossbow for hunting and/or archery.

In known archery and hunting crossbows, one of the main problems is that of their cocking because of the considerable force required to tension the bowstring.

Crossbows are known in which cocking is facilitated by the presence of a ring in the frontal area of the crossbows into which the shooter inserts a foot, so that with the crossbow bearing on the ground and secured by his/her foot, the shooter can pull the bowstring towards him/her with his/her hands until bringing it in the position in which it catches the shooting device associated to the trigger.

However, such a solution is still not very practical and it requires considerable effort on the shooter's part: in fact crossbows with tensioning exceeding 150–180 pounds (corresponding roughly to 68–82 kg) cannot be constructed.

Another manual cocking system, already used in medieval times, comprises a crank to be operated by the shooter to tension the bowstring by means of reducing mechanisms, but such a solution is operatively complex and the lesser effort required is paid for with an excessively long cocking time.

Moreover, from U.S. Pat. No. 2,520,713 a crossbow is known in which the trigger assembly can translate along the longitudial axis of the crossbow. In a first phase the trigger assembly translates towards the flexing elements to catch the bowstring and in a second phase the operator tensions the bowstring, returning the trigger device to the rear position.

The cocking action therefore takes place manually, acting on the trigger assembly instead of directly on the spring.

Thus, such a crossbow has the drawbacks of a manually cocked crossbow especially as regards the efforts the operator must exert during the cocking phase.

The sole automatic system known to the Applicant is the one disclosed in U.S. Pat. No. 5,220,906 which relates to a device to draw the bowstring of a crossbow, operated by a battery-powered electric motor and housed in a case associated in removable fashion to the crossbow.

The device comprises a shaft which is at least partly threaded and which translates relative to the case on a guide and support walls, actuated by the electric motor.

The electric motor sets in rotation (clockwise or counterclockwise depending on the position of a switch) a drive shaft whereon is keyed a first gear wheel which meshes onto a second gear wheel mounted on a sleeve having an inner thread which couples with the outer thread of the threaded shaft that translates relative to the sleeve in such a way as to transform the rotational motion of the drive shaft into translating motion of the threaded shaft relative to the trigger of the crossbow. End stop sensors are provided to check the run of the threaded shaft.

However, this solution, which is the only one described in the patent, provides for the rather bulky housing that contains the motor and the battery to be located in the front area of the crossbow in front of the shooting area, in a rather inconvenient position and which, in any case, requires the housing to be removed prior to shooting, both because of the impossibility of releasing the arrow and because the weight of the device on the tip of the crossbow would create an imbalance which would prevent the shooter from shouldering it correctly and from aiming properly.

The patent also mentions the possibility for the device to be positioned in the rear area where the crossbow is shouldered, but it fails to explain in any way how to position it, probably because the inventor did not know how to position it to obtain an effective operation.

Indeed, if the device where actually to be located in the rear part of the crossbow it would have to pull the bowstring (instead of pushing it) during the cocking phase, but the element destined to interact with the bowstring (the slots 74 of the patent) is wholly unsuitable for gripping the bowstring to pull it, as it can only push it.

Moreover, with all traditional bulky elements of the rear part of the crossbow, it is difficult to comprehend a possible installation position of the device which, among other problems, would act in a manner that is not parallel to the shooting axis (as is readily apparent also from FIG. 4 of the aforesaid document).

The lack of parallelism between the action of the automatic device and the shooting axis of the crossbow is a further drawback of the crossbow described in the aforesaid patent and it leads to the following consequences. If the device is mounted anteriorly, it produces a high level of friction of the bowstring against the frame of the crossbow and in particular against the plane whereon the arrow slides during the thrusting phase of the bowstring towards the trigger, whilst if the device is mounted posteriorly it cannot function because it would lift the bowstring relative to the plane of shooting and hence the bowstring could not be properly secured to the trigger.

Although the patent only describes the solution with the removable cocking device (which penalises the shooter who has to mount and remove the device every time he/she shoots), the patent also mentions the possibility for the device to be permanently fastened to the crossbow, but fails to explain how this would be possible and where the device would be fastened. The reason for the many gaps in the patent should be sought in the fact that the inventor probably had thought about some possible variations but without finding any possible embodiment for them and hence without putting a person versed in the art in the condition to construct and embody such variations.

In particular, the aforesaid patent fails to teach how to fasten the device in a permanent manner without influencing the balance of the crossbow and consequently penalising the shooting phase.

In effect, the solution described and illustrated in the patent is ineffective and not feasible for the many problems described above, and in fact as far as the Applicant knows such a solution has never been applied commercially, whilst the other solutions only partially mentioned but not illustrated or fully described (which, a fortiorl, have found no commercial application) do not constitute, in the Applicant's opinion, prior art.

To the aforesaid drawback one should add the fact that the cocking action is effected directly on the bowstring, thus needing an appropriate fork element destined to interact therewith. This drawback could be overcome by applying to U.S. Pat. No. 5,220,906 the teachings of U.S. Pat. No. 2,520,713, i.e. by having the electric motor act directly on a movable trigger. Such a solution would retain the aforementioned drawbacks, in particular because there would still be a lack of parallelism between the action of the automatic device and the shooting axis of the bowstring, with the aforementioned consequences.

A manually and operable system for cocking the bowstring of a crossbow is disclosed by U.S. Pat. No. 5,823,172, wherein a mechanically operated device for drawing a bowstring with an uniform tension on either side of the crossbow stock is described.

However, such a device has the same drawbacks aforementioned about the automatic system disclosed by U.S. Pat. No. 5,220,906.

In particular the cocking device is not an electromechanical automatic cocking device, acts on the bowstring through an inclined fork which can only push and not pull the bowstring and so the device has to be placed on the front edge of the crossbow and has to be removed before shooting.

DISCLOSURE OF THE INVENTION

The aim of the present invention is to eliminate the aforesaid drawbacks and to make available a device for automatically cocking a crossbow applicable to the crossbow itself in a fixed manner, with no need to remove it every time one shoots.

Another aim is to avoid frictions and jams during the crossbow cocking phase.

A further aim to achieve the above in a simple and reliable manner, without increasing the length or generally the dimensions of the crossbow itself thus avoiding imbalances which would adversely effect the shooting phase.

Said aims are fully achieved by the device of the present invention which is characterised by the content of the claims set out below and in particular in that the trigger block can translate on rectilinear path parallel to the longitudinal axis of the crossbow, in which in a first phase the trigger block advances towards the flexing element until the means for catching and releasing the bowstring automatically catch the bowstring, and in a second phase the trigger block moves back until reaching a position of correct tensioning of the bowstring in which the operation of the trigger causes the instantaneous release of the bowstring, and in that it comprises electromechanical means so shaped as to produce on the trigger block a force substantially parallel to the shooting axis of the crossbow to carry out said first and second phase.

The electromechanical means for automatically tensioning the bowstring comprise an electric motor anchored underneath the crossbow in the area between the trigger block and the butt and powered by a battery preferably housed at the rear part of the crossbow frame or at a grip of the crossbow itself.

The electromechanical means preferably comprise a ball screw whose low-friction rotation causes the movement of a sleeve associated with the trigger block by means of a draw wire sliding on pulleys.

The crossbow can also be provided with a flexing element divided into two halves, each pivotally engaged to the crossbow with the ability to rotate relative thereto in order to be easily made operative by tensioning the bowstring.

BRIEF DESCRIPTION OF THE DRAWINGS

This and other features shall become more readily apparent in the following description of a preferred embodiment illustrated, purely by way of non limiting example, in the accompanying drawing tables, in which.

DETAILED DESCRIPTION OF THE INVENTION

Figure 1:
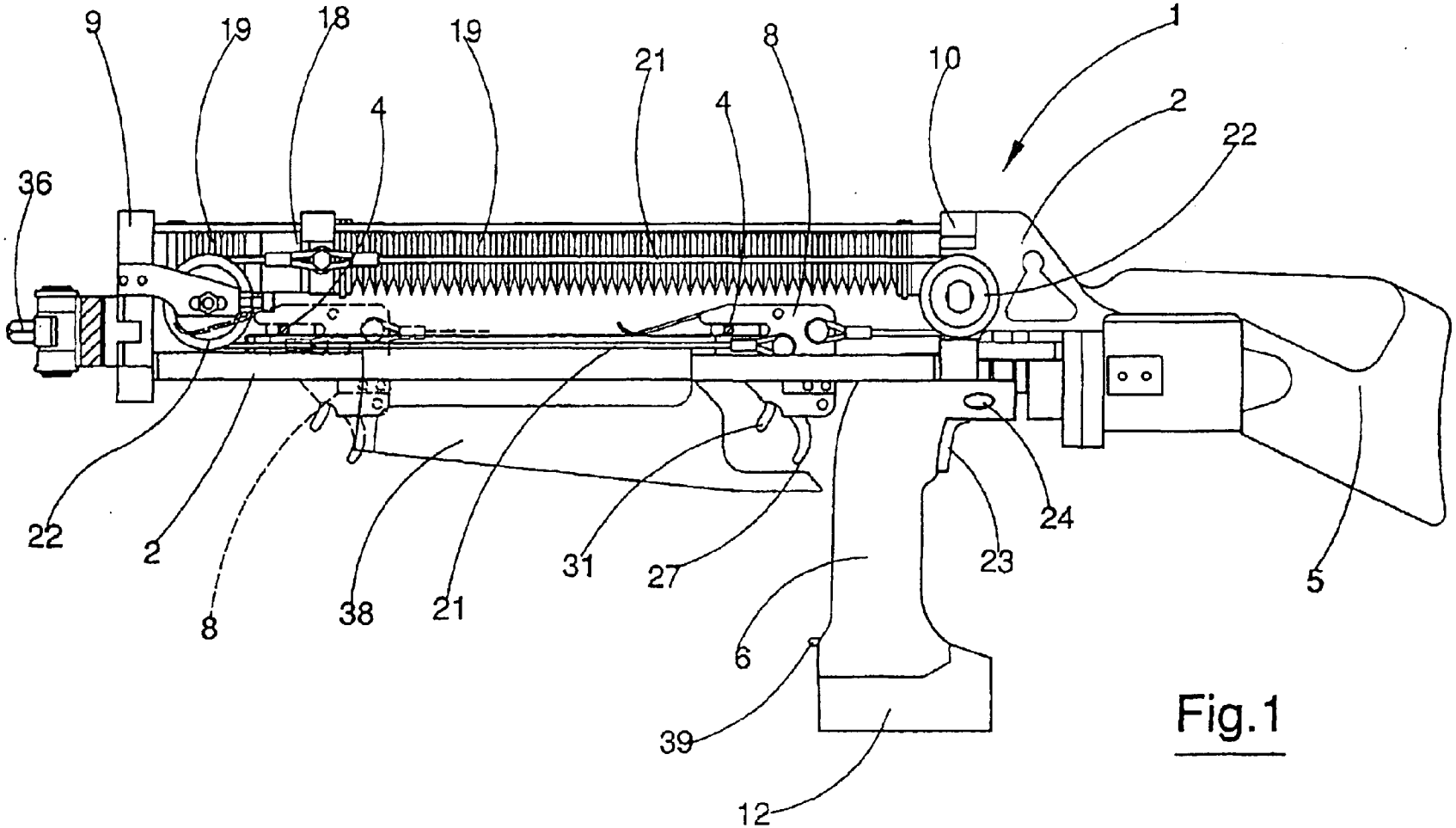
FIG. 1 shows a partially sectioned lateral view of the crossbow.
Figure 2:
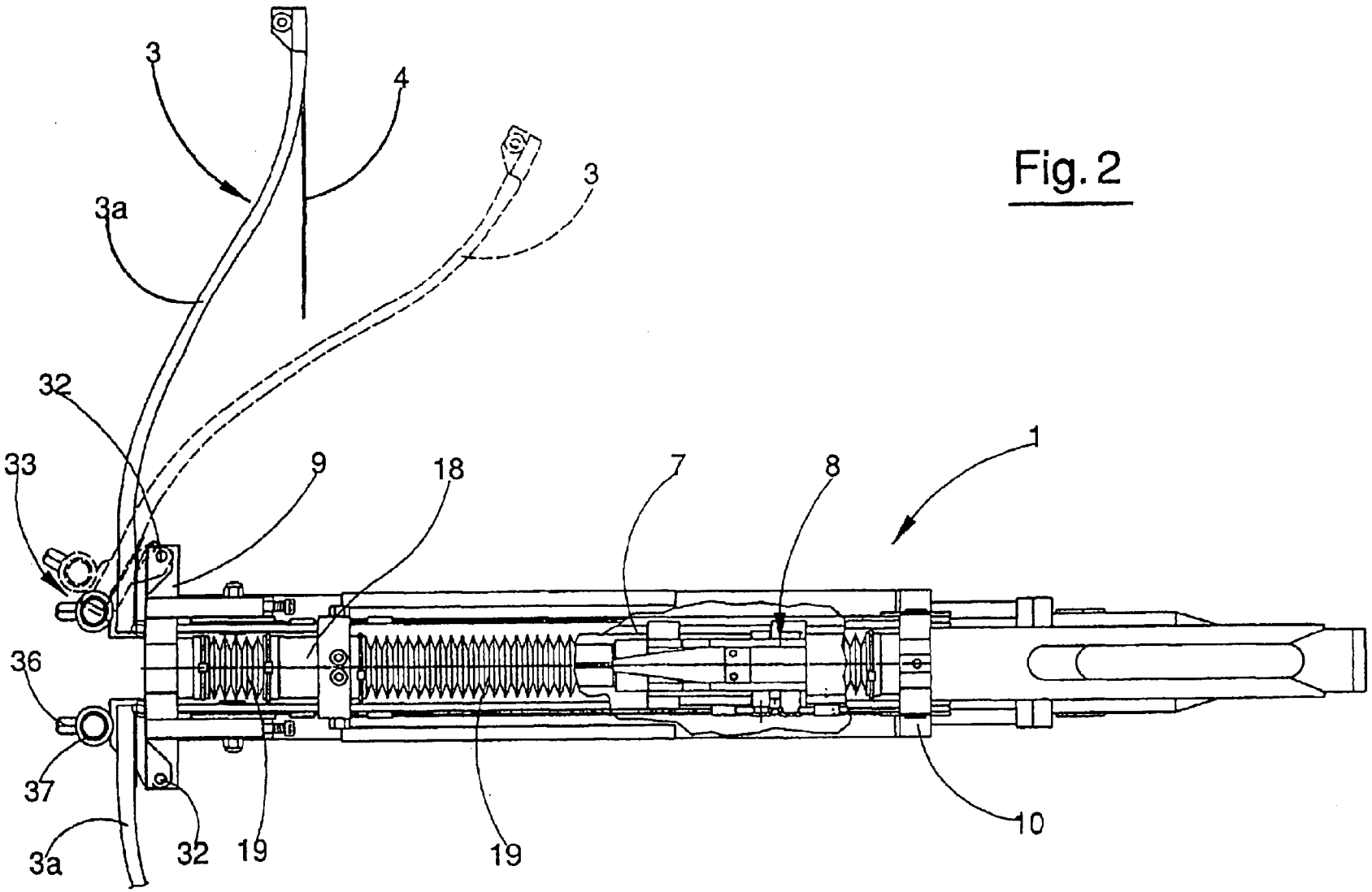
FIG. 2 shows a partially sectioned top view of the crossbow of FIG. 1.
Figure 3:
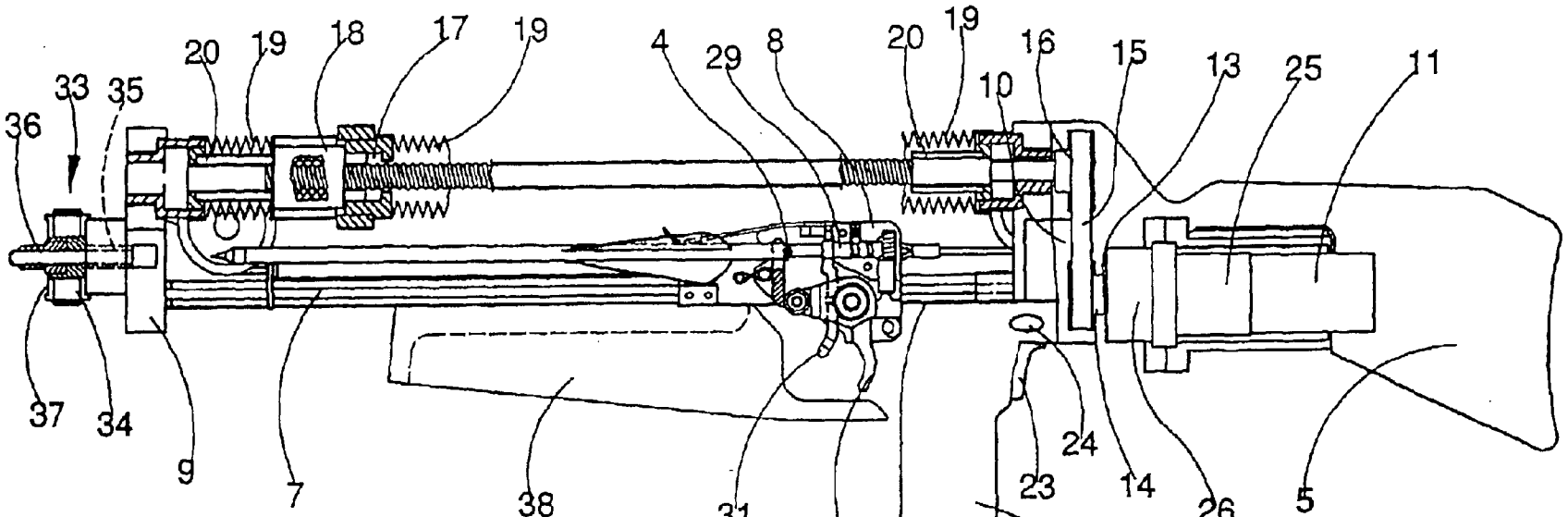
FIG. 3 shows a partially sectioned lateral view of the crossbow of FIG. 1.
Figure 5:
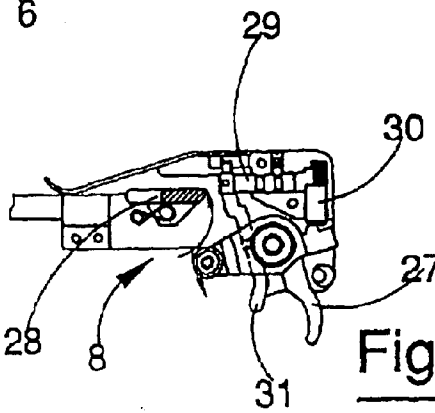
FIG. 5 shows a detail of the crossbow of FIG. 3.
Figure 4:
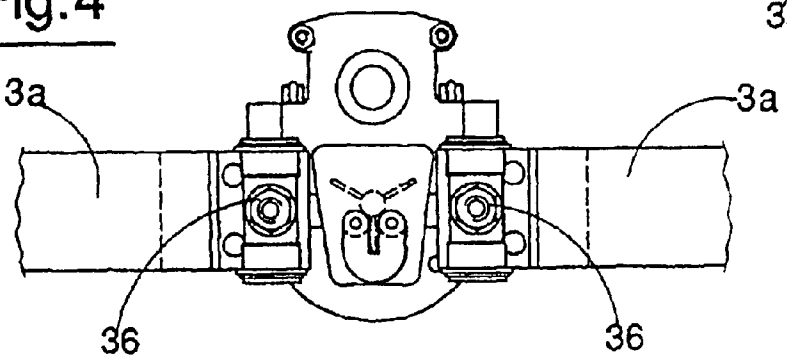
FIG. 4 shows a first view of the crossbow of FIG. 1.

With reference to the figures, the number 1 globally refers to a hunting crossbow (though it could also be an archery crossbow) which in some figures is shown without its covering fairing, the better to highlight its internal components.

The crossbow 1 comprises a frame 2 which extends longitudinally and ends frontally with a flexing element 3 for tensioning a bowstring 4, whilst in the rear part it is provided with a butt 5 for the correct positioning of the crossbow by the shooter.

The frame 2 further comprises two grips 6 and 38 which extends inferiorly from the frame itself to allow the shooter to sustain and operate the crossbow 1.

As the figures show, the distance between the grip 6 and the butt 5 is smaller than, and in particular equal to about 0.5–0.8 times, the distance between the grip 6 and the front end of the crossbow. This solution makes the crossbow extremely compact and easy to handle. Moreover the frame 2 comprises in the front part two longitudinal and parallel guides 7, whereon slides a trigger block 8 provided with means for catching and releasing the bowstring of a substantially known kind and hence not described in detail herein.

In this way the trigger block 8 can originally translate on a rectilinear path, parallel to the shooting axis of the crossbow, in which during a first phase the trigger block advances towards the flexing element 3 until the means for catching and releasing the bowstring automatically catch the bowstring 4, and in a second phase the trigger block 8 moves back until reaching a position of correct tensioning of the bowstring in which the operation of the trigger causes the bowstring to be released instantaneously.

The guides 7 are obtained by means of mutually parallel tension rods and are fastened anteriorly to a support 9, which also sustains the flexing elements, and posteriorly to a plate 10 comprised in the frame 2 and in particular in the portion that embodies the butt 5.

An electric motor 11 and a battery 12 are associated to the crossbow and substantially incorporated therein. In particular the butt 5 internally houses the electric motor, whilst the battery 12 can advantageously be inserted in the grip 6 of the crossbow. The battery 12 therefore is anchored in removable fashion by means of a pushbutton 39.

The operation of the electric motor causes the rotation of a drive shaft 13 whereon is keyed a first pulley 14 which through a transmission belt 15 sets in rotation a second pulley 16 keyed onto the end of a ball screw 17 housed between the support 9 and the plate 10, parallel and superiorly relative to the shooting axis or longitudinal axis of the crossbow. In particular the ball screw is positioned centrally relative to the longitudinal axis of the crossbow, in such a way as not to affect the stability of the crossbow, especially when shooting.

The ball screw 17 is a known device, essentially comprising a worm screw whereon slides a cylindrical sleeve 18 internally provided with balls that interact with the thread of the screw, allowing 95% efficiency in terms of friction.

As shown in the figure, the ball screw 17 is inserted in two bellows 19, respectively introduced between the support 9 and the sleeve 18 and between the sleeve 18 and the plate 10, to protect moving parts.

The sleeve 18 is connected to the trigger block 8 in such a way that, when the electric motor causes the rotation of the ball screw, the sleeve 18 translates thereon causing a corresponding translation, of equal extent, of the trigger block 8.

The ball screw 17 also has two shock absorbing elements 20 to brake the run of the sleeve and operate a spring clutch comprised in a spring assembly 26. Said shock absorbing elements can be embodied by helical springs or rubber elements.

The electric motor 11 with the ball screw 17 and the sleeve 18 constitute electromechanical means for the automatic tensioning of the bowstring, originally shaped in such a way as to produce, on the trigger block 8, a force that is substantially parallel to the longitudinal or shooting axis of the crossbow.

For this purpose the electromechanical means further comprise a driving element intregal the trigger block, obtained by means of two draw wires 21 actuated by the electric motor. The two draw wires 21 are positioned on the sides of the ball screw 17 and each of them has both its ends integral with the trigger block 8.

The draw wire 21 is integral, in its intermediate position, with the sleeve 18 and slides on pulleys 22 mounted able to rotate on the frame 2 from opposite sides along the run of the trigger block 8.

The presence of the draw wires 21, able to slide on the pulleys 22, guarantees the action of a force substantially parallel to the longitudinal or shooting axis of the crossbow, together with the action exerted by the ball screw 17, by the sleeve 18, able to slide on the ball screw 17 and by the guides 7.

For the operation of the electric motor 11, an electronic speed control unit, indicated with 23, is provided together with a control 24 to determine the direction of rotation of the motor (and hence of translation of the trigger assembly). The speed control unit 23 and the control 24 can be applied to the grip 6, as shown in FIG. 1.

The electric motor 11 is also provided with an epicyclical reduction gear 25 and with the clutch assembly 26 interposed between the electric motor and the first pulley 14.

The trigger block 8 is of a substantially known type (apart from the ability to translate) and comprises an actual trigger 27 pivotally engaged on the trigger assembly 8 by means of a bearing and operatively associated to a catch 28 to hold the bowstring 4. Associated to the trigger assembly 8 is further provided a safety device 29, comprising a breech bolt 30 and a safety lever 31.

As shown in the figure, the flexing element can be subdivided in two halves 3*a* each of which is pivotally engaged in 32 to the crossbow. Each half is shaped as to be able to rotate relative to the frame 2 to shift from a rest position, in which the two halves are substantially parallel to the frame, to a working position, in which the two halves extend transversely relative to the frame to tension the bowstring, and vice versa.

In particular, means 33 for locking and tensioning the bowstring are provided with the purpose of tensioning the bowstring 4. Said means comprise two pivot pins 34 having a first end integral with the frame of the bowstring and able to be inserted into a slot 35 obtained in each of the two halves in proximity to the end pivotally engaged to the frame. The locking action is effected by means of threaded elements 36 able to be operatively associated to the pivot pins, by the interposition of an element 37, at least partially cylindrical, to facilitate the placement of the halves in the working position.

According to an embodiment variation not shown herein, the flexing element can be single and fastened to the crossbow. In this case, a provisional exterior string is used, tensioning which the flexing element is bent until the actual string can be inserted, according to a known technology.

As regards the positioning of the device, when the bowstring is to be tensioned acting on the flexing element 3, it is necessary to insert the pivot pins 34 in the respective slots 35 and to screw the threaded elements 36 by approaching the two parts of the flexing element to the support 9. The presence of the element 37 reduces friction and facilitates the locking of the flexing element.

When it is necessary to cock the crossbow again after releasing an arrow, it is sufficient to act on the pushbutton for the operation of the electric motor to cause the trigger block to advance towards the bowstring.

Before the trigger block reaches the aforesaid end stop, the bowstring is automatically engaged in its catching device comprises in the trigger block, automatically engaging the safety device that prevents accidental releases of the arrow.

By inverting the direction of motion of the motor, it is possible to command the adjustable tensioning of the bowstring, by returning the trigger block in position. The sleeve 18 drives the draw wire 21 which slides along the pulleys 22 and generates the translation of the trigger block 8 until the tun of the sleeve is limited by the shock absorbing elements 20 and arrested by the clutch 26. The presence of the two draw wires positioned symmetrically relative to the axis of the crossbow guarantees a balanced, frictionless interaction between the trigger block 8 and the respective guides 7 and exerts on the trigger block a force parallel to the shooting axis of the crossbow.

The main advantages of the present device consist of the capability to shoot several times with no effort on the operator's part and of the capability to load far greater powers than in current systems, in the capability to uncock the weapon without necessarily shooting the arrow (it is sufficient to operate the electric motor as in the initial phase to move the trigger block closer to the flexing element, thereby reducing the tension on the bowstring), in the availability of a cocking device incorporated in the crossbow itself and in such a position that it does not hamper or hinder the operator in shooting operations.

In particular, unlike U.S. Pat. No. 5,220,906, no element is positioned in front of the flexing elements, and this allows for perfect balancing of the crossbow.

A further feature and advantage of the present automatic cocking device is given by the fact that it operates with a force that is parallel to that of the arrow and therefore entails no jams or frictions during the cocking phase or modifications on the trajectory of the arrow during the launching phase.

The present device further allows for contacting of the bowstring always in the same place and centrally, avoiding asymmetries.

What is claimed is:

1. An automatic cocking device in a crossbow (1) for hunting and/or archery, of the type comprising:

a frame (2) having at least a flexing element (3) and a bowstring (4) strung between opposite ends of the flexing element (3) and positioned substantially perpendicular, under rest conditions, to a shooting axis of the crossbow;

electromechanical means for the automatic cocking of the bowstring (4), said electromechanical means comprising at least a feeding device and actuator means;

a trigger block (8) provided with means for catching and releasing the bowstring;

wherein said trigger block (8) translates on a rectilinear path with a draw line coaxial to the longitudinal axis of the crossbow, in which in a first phase the trigger block advances towards the flexing element (3) until means for catching and releasing the bowstring automatically catch the bowstring (4), and in a second phase the trigger block (8) moves back until reaching a position of correct tensioning of the bowstring in which operation of the trigger causes instantaneous release of the bowstring, and wherein said electromechanical means are so shaped as to produce on the trigger block (8) a force that is substantially coaxial to the shooting axis of the crossbow to carry out said first and second phase.

2. A device as claimed in claim 1, wherein said electromechanical means comprise at least a drawing element integral with the trigger block (8) and actuated by the electromechanical means, the actuator means being integral with the crossbow and positioned in a manner that does not necessitate removal thereof before shooting.

3. A device as claimed in claim 2, wherein the drawing element includes at least a draw wire (21) actuated by the electromechanical means and having at least an end integral with the trigger block (8).

4. A device as claimed in claim 3, wherein the draw wire (21) has both its ends integral with the trigger block (8) and slides on rotating pulleys (22) mounted on the frame (2) at opposite sides along the run of the trigger block.

5. A device as claimed in any of the claims from 2 to 4, wherein said electromechanical means comprise:

a ball screw (17) positioned parallel to the longitudinal axis of the crossbow and cinematically connected to an electric motor (11) which causes its actuation;

a sleeve (18), sliding on the ball screw towards the front part of the crossbow or towards its rear part depending on the direction of rotation of the ball screws, and operatively associated to the drawing element of the trigger block.

6. A device as claimed in claim 5, wherein said ball screw (17) comprises at each end a shock absorbing element (20) to brake the run of the sleeve (18) and operate a clutch assembly (26).

7. A device as claimed in claim 1, wherein the electromechanical means further comprise at least a guide (7) integral with the frame (2) of the crossbow parallel to the longitudinal axis thereof, whereon the trigger block (8) slides.

8. A device as claimed in claim 1, wherein the electromechanical means comprise:

an electric motor (11) anchored in the area between the trigger block (8) and a butt (5) or the rear part of the crossbow, and a battery (12) connected to the electric motor to power the same.

9. A device as claimed in claim 8, wherein the battery (12) is anchored, in a removable manner by a pushbutton (39), to a grip (6) integral with the frame (2) of the crossbow.

10. A device as claimed in claim 8, wherein the battery (12) is anchored, in a removable manner, to the rear part of the frame (2) of the crossbow between the trigger block (8) and the butt (5) or terminal part of the crossbow.

11. A device as claimed in claim 8, wherein the electromechanical means further comprise an epicyclical reduction gear (25) associated with the electric motor (11).

12. A device as claimed in claim 11, wherein the electromechanical means further comprise a clutch assembly (26) associated with the electric motor.

13. A device as claimed in claim 1, wherein the flexing element (3) is divided in two halves (3*a*), each of which is pivotally engaged to the frame (2) of the crossbow and so shaped as to be able to rotate relative thereto in order to shift from a resting position, in which the two halves are substantially parallel to the frame, to a working position, in which the two halves extend transversely relative to the frame to tension the bowstring, and vice versa.

14. A device as claimed in claim 13, wherein each of the halves (3*a*) comprises means for locking and tensioning (33) the bowstring, which operate to shift from the resting position to the working position.

15. A device as claimed in claim 14, wherein the locking and tensioning means (33) comprise:

two pivot pins (34) having a first end integral with the frame (2) of the crossbow;

a slot (35) in each of the two halves in proximity to the first end pivotally engaged to the frame to receive said pivot pin (34);

threaded elements (36) able to be operatively associated to said pivot pin (34) to lock the two halves (3*a*) in the working position.

16. A device as claimed in claim 15, wherein the locking and tensioning means (33) further comprise:

an element (37) that is at least partially cylindrical and inserted between one half (3*a*) and the respective threaded element to facilitate positioning of the halves in the working position.

17. A crossbow comprising a device according to claim 1.

18. A crossbow as claimed in claim 17, wherein the distance between a grip (6) and a butt (5) is lesser than the distance between the grip (6) and the front end of the crossbow.

19. A crossbow as claimed in claim 18, wherein the distance between a grip (6) and a butt (5) is lesser by a factor of 0.5–0.8 than the distance between the grip (6) and the front end of the crossbow.

20. A crossbow as claimed in claim 17, wherein no element is applied to the front end of the crossbow.

21. A crossbow as claimed in claim 17, wherein the device further comprises an electric motor (11), an epicyclical reduction gear (25), and a clutch assembly (26), all of which are positioned in the rear part of the crossbow.

22. A crossbow as claimed in claim 17, wherein the device further comprises a ball screw (17) positioned centrally parallel and superiorly relative to the shooting axis or longitudinal axis of the crossbow.

23. A crossbow as claimed in claim 17, wherein the electromechanical means allow uncocking of the crossbow without necessarily shooting an arrow.

* * * * *